US006047418A

United States Patent [19]

Seide et al.

[11] Patent Number: 6,047,418

[45] Date of Patent: Apr. 11, 2000

[54] INVALID LIFTING DEVICE

[75] Inventors: Klaus Seide, Reinbeck, Germany; Philip von Schoeter, Gloucester, United Kingdom

[73] Assignee: Arjo Limited, Gloucestershire, United Kingdom

[21] Appl. No.: 09/068,158

[22] PCT Filed: Oct. 29, 1996

[86] PCT No.: PCT/GB96/02630

§ 371 Date: Jun. 9, 1998

§ 102(e) Date: Jun. 9, 1998

[87] PCT Pub. No.: WO97/17048

PCT Pub. Date: May 15, 1997

[30] Foreign Application Priority Data

Nov. 4, 1995 [GB] United Kingdom ..... 9522625
Jan. 9, 1996 [GB] United Kingdom ..... 9600340

[51] Int. Cl.[7] ..... A61G 7/10

[52] U.S. Cl. ..... 5/83.1; 5/81.1 R; 5/89.1

[58] Field of Search ..... 5/81.1 R, 83.1, 5/85.1, 87.1, 88.1, 86.1, 89.1; 414/460, 921; 212/343

[56] References Cited

U.S. PATENT DOCUMENTS

| | | | |
|---|---|---|---|
| 1,961,119 | 5/1934 | Ettinger | 5/89.1 |
| 1,962,042 | 6/1934 | Stevenson . | |
| 2,339,007 | 1/1944 | Gahm | 5/81.1 R |
| 2,659,092 | 11/1953 | Conyers . | |
| 3,877,421 | 4/1975 | Brown | 5/81.1 R |
| 3,999,228 | 12/1976 | Thomas . | |
| 5,187,822 | 2/1993 | Merry . | |
| 5,499,408 | 3/1996 | Nix | 5/85.1 |
| 5,579,547 | 12/1996 | Hunt | 5/86.1 |
| 5,784,730 | 7/1998 | Hunt | 5/86.1 |
| 5,845,348 | 12/1998 | Dunn et al. | 5/83.1 |

FOREIGN PATENT DOCUMENTS

| | | |
|---|---|---|
| 483565 | 7/1917 | France . |
| 1 226 245 | 10/1966 | Germany . |
| 102921 | 1/1917 | United Kingdom . |
| 2 272 679 | 5/1994 | United Kingdom . |
| 2 306 941 | 5/1997 | United Kingdom . |

*Primary Examiner*—Terry Lee Melius
*Assistant Examiner*—James M Hewitt
*Attorney, Agent, or Firm*—Young & Thompson

[57] ABSTRACT

The invalid lifting device comprises two support members 110 and 111 each having at least one vertical or substantially vertical leg 112, 115 and a transverse arm 114, 117 at or adjacent to the upper end of the leg. The two transverse are pivotable relative to one another about a vertical or substantially vertical axis so that the two support members can be displaced angularly relative to one another. A hoist 127, 128 is supported by one of the support members.

18 Claims, 6 Drawing Sheets

INVALID LIFTING DEVICE

Figure 1:
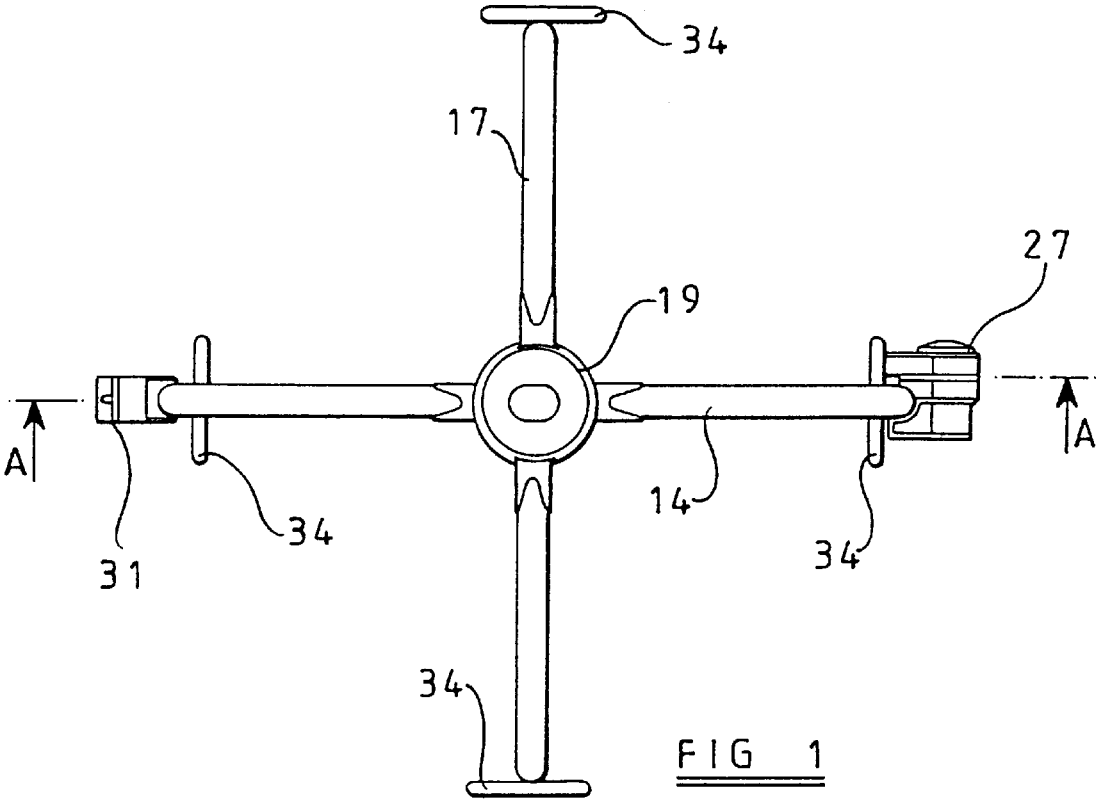

This invention relates to a device for lifting invalid patients.

According to one aspect of the present invention there is provided an invalid lifting device comprising two support members each having at least one vertical or substantially vertical leg and a transverse arm at or adjacent to the upper end of the leg, the two transverse arms being pivotable relative to one another about a vertical or substantially vertical axis so that the two support members can be displaced angularly relative to one another, and a hoist supported by one of the support members.

Preferably, power operated means are provided for pivoting the two transverse arms relative to one another. In this case, the power operated means may comprise an electric motor supported with respect to one of the transverse arms and drivingly connected to the other transverse arm, such as through gears.

Preferably, the hoist comprises a power operated winch, a flexible elongate element which can be extended and retracted by the winch and a sling support connected to the free end of the flexible elongate element. In this case, the flexible elongate element preferably depends from one of the transverse arms at or adjacent to the pivot axis of the transverse arms. The winch may be supported by said at least one leg of one of the support members and the flexible elongate element may be guided to a position in which it depends from one of the transverse arms at or adjacent to the pivot axis of the transverse arms.

In one embodiment, each support member has two spaced apart vertical or substantially vertical legs connected together at or adjacent to their upper ends by a transverse arm in the form of a cross arm. In this case, the cross arms are preferably pivotably connected together midway or substantially midway between their ends. The lower ends of the legs are, preferably, provided with wheels or castors. In this case, the legs of one of the support members may be provided with braking means which may take the form of extendible feet which can be extended to engage the floor.

Preferably, the two support members of said one embodiment are angularly displaceable relative to one another between a position in which the transverse arms extend perpendicularly or substantially perpendicularly to one another and a position in which the transverse arms extend at an angle no greater than 20° to one another.

In another embodiment, each support member has only one vertical or substantially vertical leg and stabilizing means are provided at the lower end of each leg to prevent the lifting device from falling over. The stabilising means may be in the form of elongate chassis members which may be kept parallel or substantially parallel, such as by drive motors, as the support members are pivoted relative to one another. Each chassis member may have two wheels or castors and may be provided with braking means.

Preferably, the two support members of said another embodiment are angularly displaceable relative to one another between a position in which the transverse arms extend at an angle of at least 90° to one another (and preferably at a greater angle, typically about 105°) and a position in which the transverse arms extend at an angle no greater than 20° to one another.

Preferably, at least one of the legs is provided with a handle whereby an operator can move the hoist along the floor.

Preferably, the sling support comprises a sling hanger and a sling hanger support, the sling hanger support being connected to the free end of the flexible elongate element and the sling hanger being connected to the sling hanger support for pivotable movement about a horizontal or substantially horizontal axis and having two spaced sling attachment points on one side of the horizontal axis and at least one sling attachment point on the other side of the horizontal axis.

According to another aspect of the invention there is provided an invalid lifting device comprising two support members movable relative to one another between a first position in which the support members can straddle a standard single hospital bed and a second position in which the support members can pass through a doorway of minimum standard width, and a hoist supported by one of the support members.

The width of a standard hospital bed is 95 cm and the minimum width of standard doorway is 90 cm.

Preferably, the two support members are pivotably movable between said first and second positions and the hoist includes a flexible elongate element which is suspended from a position coincident with, or adjacent to, the axis of pivotable movement of the two support members.

Figure 2:
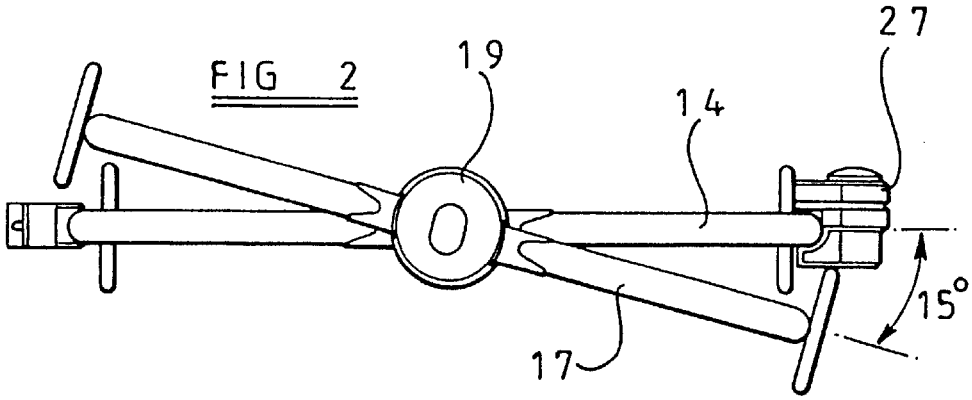
Figure 3:
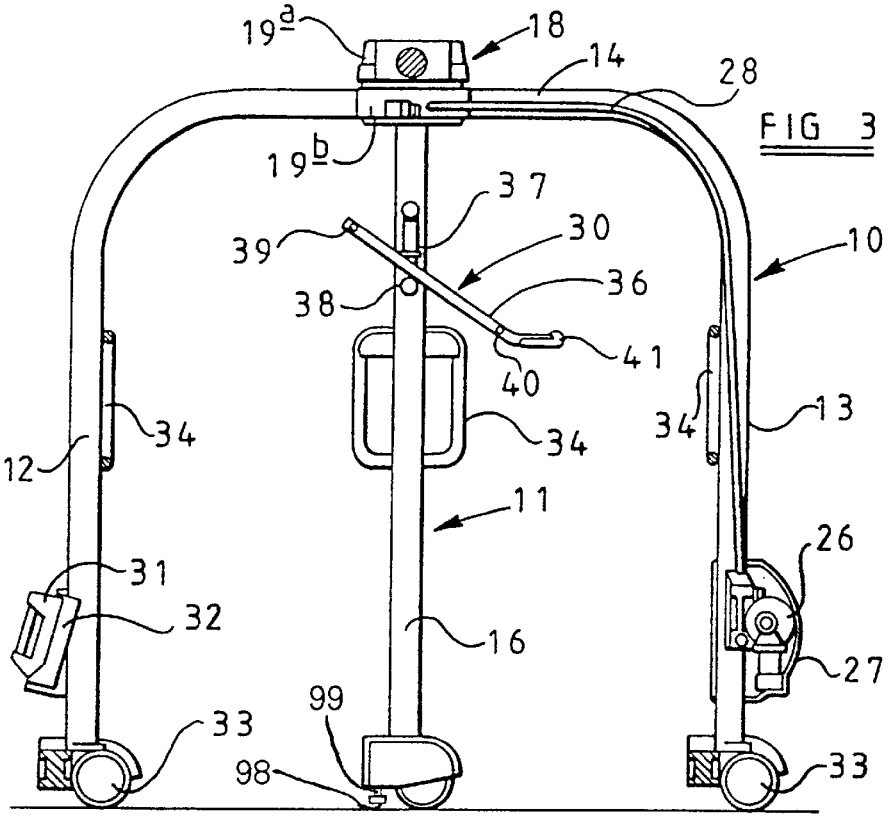
Figure 4:
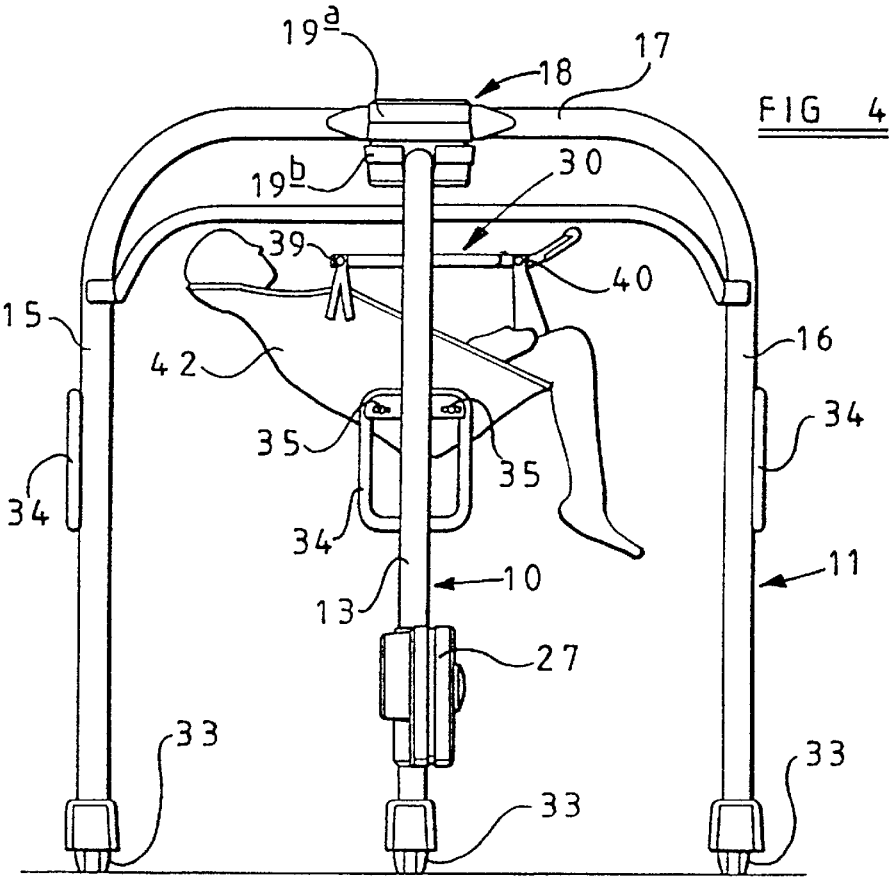
Figure 5:
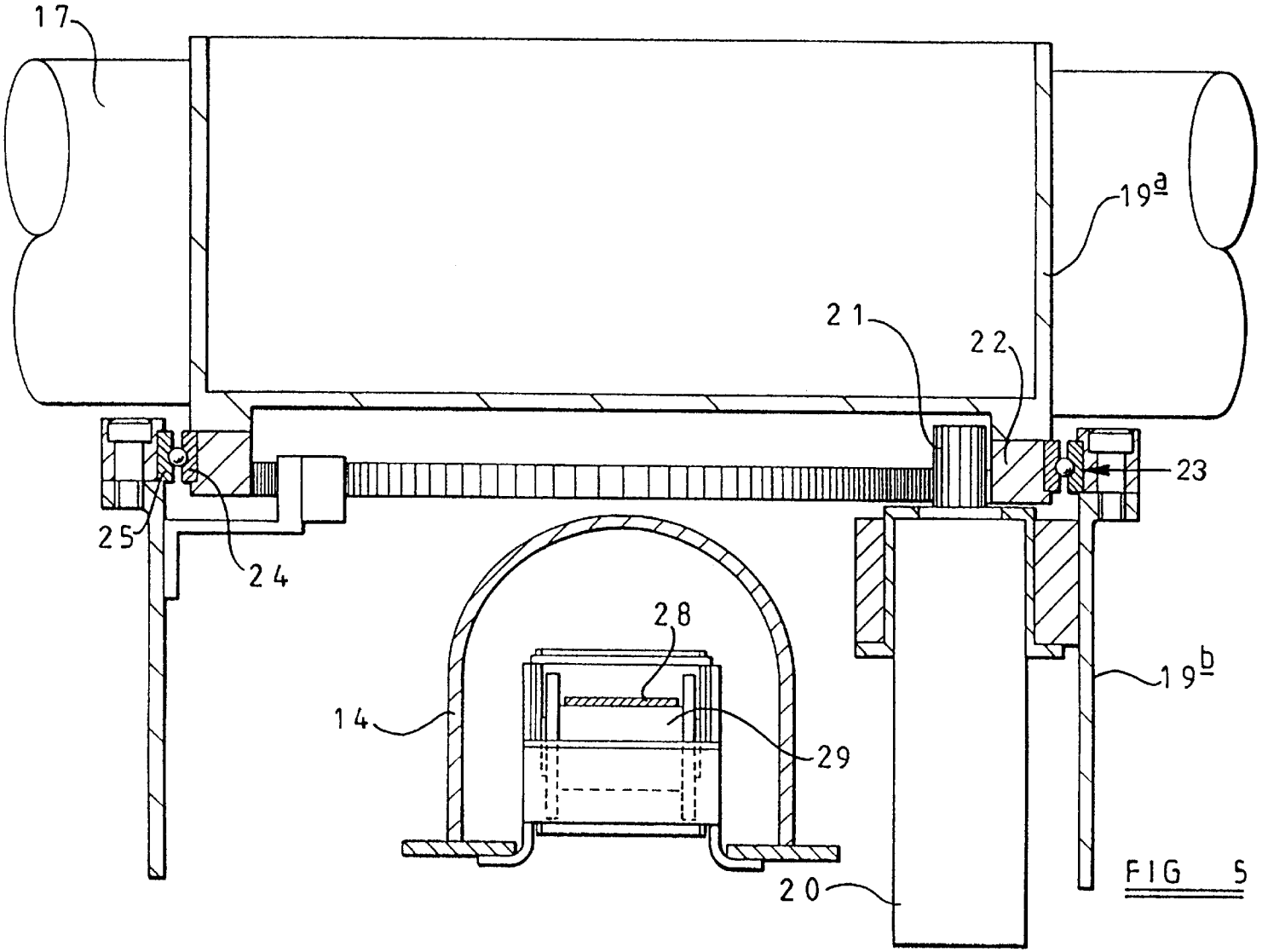
Figure 6:
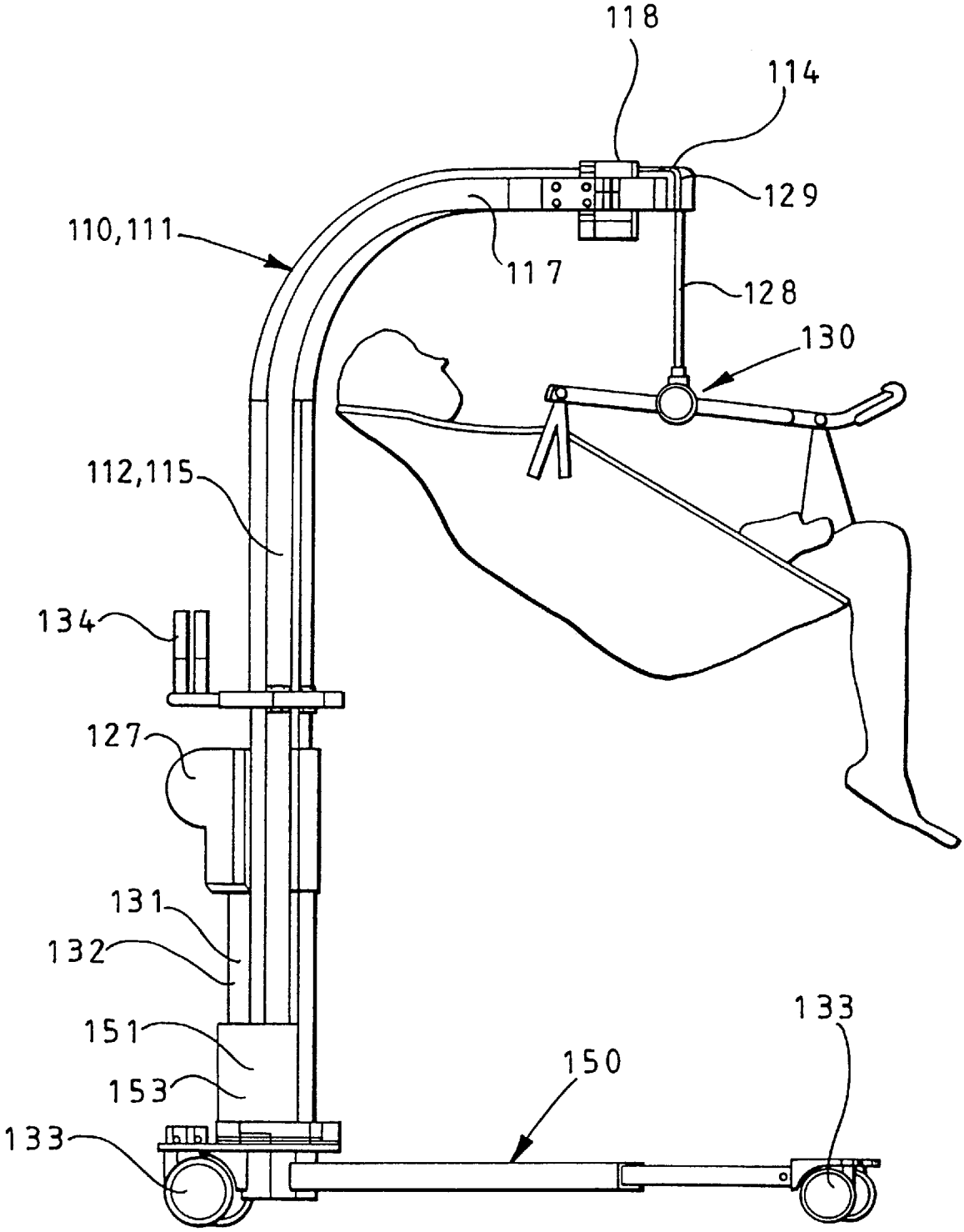
Figure 7:
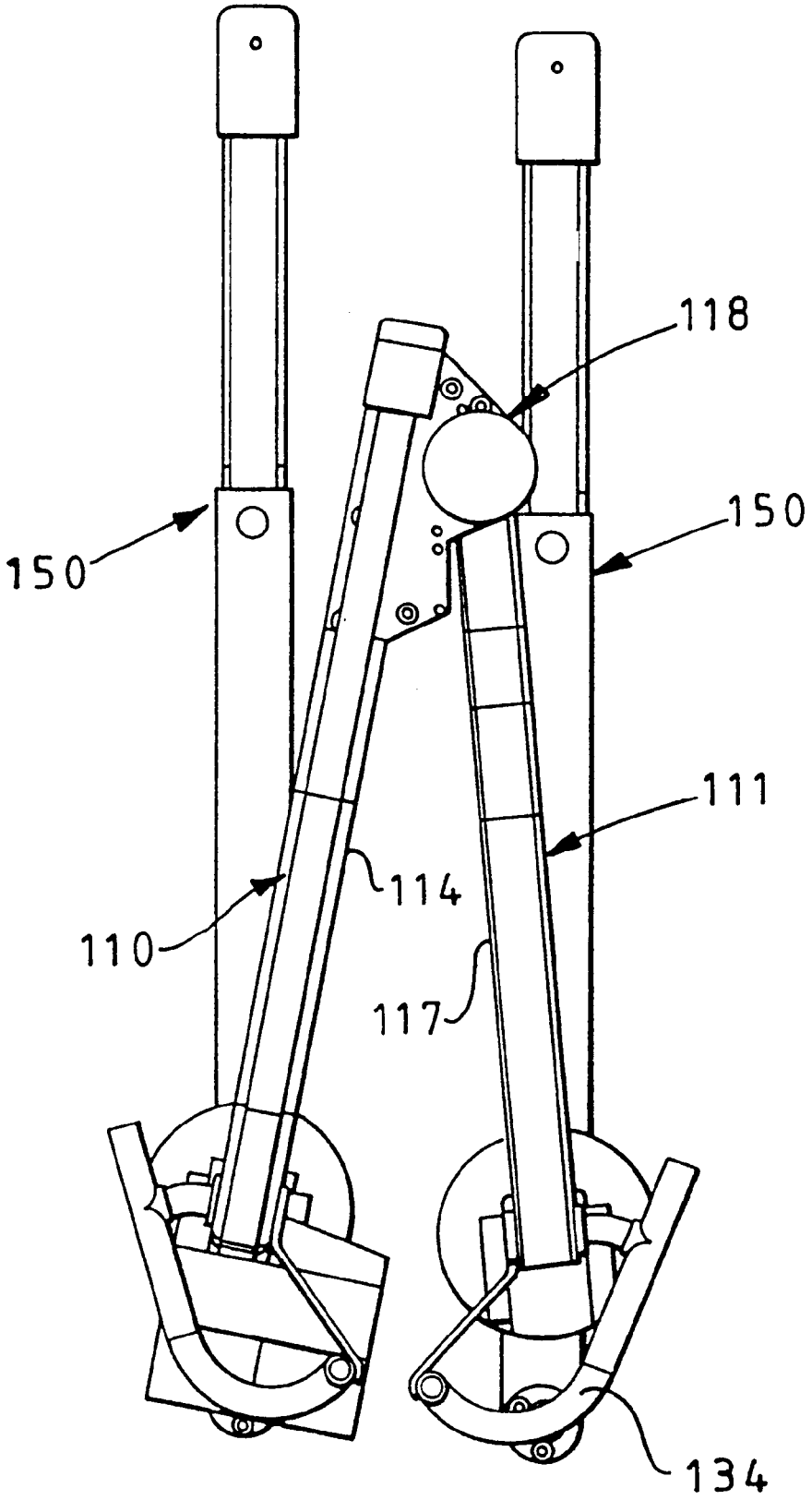
Figure 8:
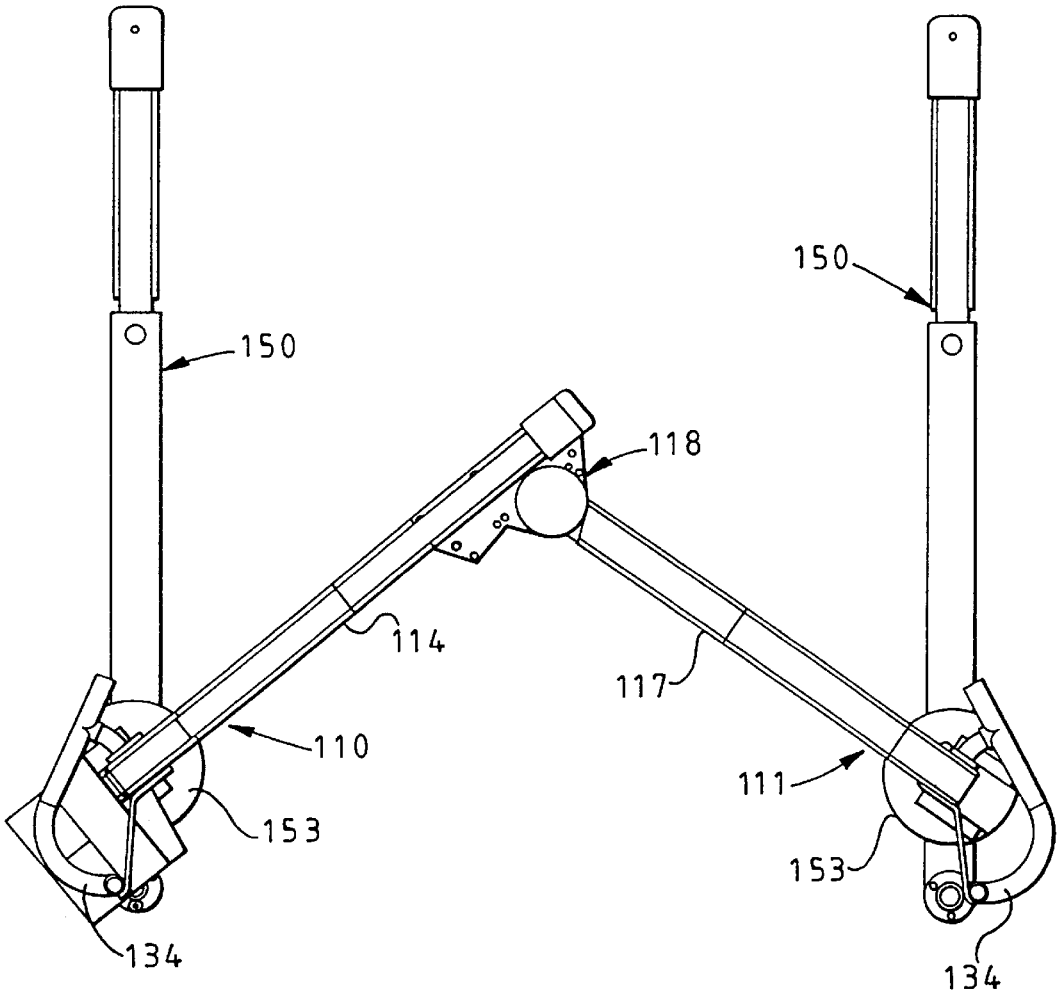

The invention will now be more particularly described, by way of example, with reference to the accompanying drawings, in which:

FIG. 1 is a plan view of one embodiment of an invalid lifting device according to the present invention, in an operable condition, FIG. 2 is a plan view similar to FIG. 1, but showing the lifting device in a collapsed, storage condition, FIG. 3 is a sectional view taken along the line A—A of FIG. 1, FIG. 4 is a view in the direction of arrow A of in FIG. 3, with an invalid suspended from the hoist, FIG. 5 is a sectional fragmentary view of the lifting device on an enlarged scale, FIG. 6 is a side view of another embodiment of an invalid lifting device according to the invention, FIG. 7 is a plan view of the lifting device shown in FIG. 6 in a collapsed condition, and FIG. 8 is a view similar to FIG. 7 but showing the lifting device in a fully extended condition.

Referring firstly to FIGS. 1 to 5 of the drawings, the invalid lifting device shown therein comprises two support members 10 and 11. The support member 10 comprises two spaced apart vertical or substantially vertical legs 12 and 13 connected together at their upper ends by a cross arm 14. The support member 11 also comprises two spaced apart vertical or substantially vertical legs 15 and 16 connected together at their upper ends by a cross arm 17. The legs 12, 13, 15 and 16 and the cross arms 14 and 17 are all of tubular construction.

The cross arms 14 and 17 are pivotable relative to one another about a vertical axis midway between the ends of the two cross arms 14 and 17. For this purpose, the legs 12 and 13 of the support member 10 are slightly shorter than the legs 15 and 16 of the support member 11 so that the cross arm 14 is disposed below the cross arm 17.

A power operated drive unit 18 is used to pivot the two cross arms relative to one another. This drive unit 18 is housed in a two part casing 19. The upper part 19*a* of the casing is secured to the centre of the cross arm 17 and the lower part l9*b* of the casing is secured to the centre of the cross arm 14.

As shown in FIG. 5, the drive unit 18 comprises an electric motor 20 secured to the lower casing part 19*b*, a pinion gear 21 fixed to the shaft of the motor 20 and a ring gear 22 fixed to the upper casing part 19*a*. A ball bearing assembly 23 having inner and outer races 24 and 25 is mounted between the upper and lower casing parts 19*a* and 19*b* and the pinion gear 21 meshes with the ring gear 22 so that rotation of the motor 20 will cause the two casing parts 19*a* and 19*b*, and therefore the two cross arms 14 and 17, to be angularly displaced relative to one another.

The lifting device also includes a hoist comprising a power operated winch 26 housed within a casing 27 at the lower end of the leg 13, a flexible elongate tape 28 which is guided through the leg 13 and over a pulley 29 in the cross arm 14 midway between its ends and a sling support 30 connected to the free end of the tape 28.

The motor 20 and winch 26 are powered by a re-chargeable battery 31 which is removably supported in a holder 32 on the leg 12. Connecting leads between the battery holder 32 and the motor 20 extend through the leg 12 and cross arm 14 and connecting leads between the holder 32 and the winch 26 extend through the leg 12, the cross arm 14 and the leg 13.

Each leg has a wheel or castor 33 at its lower end. The legs 15 and 16 are provided with brakes (not shown) in the form of extendible feet 99. These feet have rubber pads 98 on their lower end and can be lowered into engagement with the floor by electrically operated actuators.

The castors 33 may also have means for releasably locking them in a desired angular orientation.

Each leg 12, 13, 15 and 16 is provided with a handle 34 and these handles 34 may incorporate electric switches 35 for operating the winch 26, the motor 20 and the aforesaid electrically operated actuators.

The sling support 30 comprises a sling hanger 36 and a sling hanger support 37. The sling hanger support 37 is connected to the free end of the tape 28 and the sling hanger 36 is connected to the hanger support 37 for pivotable movement about a horizontal axis 38. The sling hanger 36 has two spaced sling attachment points 39 on one side of the horizontal axis 38, at least one sling attachment point 40 on the other side of the horizontal axis 38 and a handle 41 for pivoting the hanger 36 relative to the hanger support 37. This enables a patient to be supported in a body support sling 42 and raised from a seated or supine position and lowered into a seated or supine position.

In a normal operating position, the support members 10 and 11 extend at right angles to one another as shown in FIGS. 1, 3 and 4. This gives the lifting device greatest stability.

However, the support members 10 and 11 can be displaced angularly by the motor 20 to a position as shown in FIG. 2 in which they extend at no more than 20°, and preferably at about 15°, to one another for storage purposes.

The motor 20 can angularly displace the two support members 10 and 11 between the position shown in FIG. 1 and a position in which the support members extend at about 50° one another whilst carrying a load. This will enable the lifting device to be moved through doors. However, a control system including a load sensor (not shown) is provided to prevent the motor 20 displacing the support members 10 and 11 to an angle of less than about 50° when the lifting device is carrying a load as a safety precaution. The control system also includes limit switches for stopping the motor 20 at extreme positions of the support members 10 and 11.

The lifting device described above is particularly suitable for carrying heavy patients as it is extremely strong and stable.

Referring now to FIGS. 6 to 8 of the drawings, the invalid lifting device shown therein comprises two support members 110 and 111. The support member 110 comprises a single vertical or substantially vertical leg 112 and a transverse arm 114 at the upper end of the leg 112. The support member 111 also comprises a single vertical or substantially vertical leg 115 and a transverse arm 117 at the upper end of the leg 115. The legs 112 and 115 and the transverse arms 114 and 117 are all of tubular construction.

The free ends of the two transverse arms 114 and 117 are pivotable relative to one another about a vertical axis.

A power operated drive unit 118 is used to pivot the two transverse arms relative to one another. The drive unit 118 may be similar to the drive unit 18. Alternatively, it could include a worm gear.

The lifting device also includes a hoist comprising a power operated winch housed within a casing 127 mounted on the leg 112, a flexible elongate tape 128 which is guided through the leg 112 and over a pulley 129 at the free end of the transverse arm 114 and a sling support 130 connected to the free end of the tape 128.

The power operated drive unit 118 and winch are powered by a rechargeable battery 131 which is removably supported in a holder 132 on the leg 112. Connecting leads between the battery holder 132 and the power operated drive unit 118 extend through the leg 112.

Each leg has an elongate chassis member 150 at its lower end. Each chassis member 150 may be telescopically extendible. The chassis members 150 are maintained in parallel spaced apart relationship by encoded motors 151 which are housed in respective casings 153 and which pivot the chassis members about respective vertical axes relative to respective legs as the transverse arms 114 and 117 are pivoted relative to one another. Although this is a desirable feature, it may not prove to be essential. Instead of the encoded motors, an actuated parallelogram may be used.

Each chassis member 150 has two wheels or castors 133. At least one wheel or castor of each chassis member may be equipped with a manually operable brake.

Each leg 112, 115 is provided with a handle 134.

The sling support 130 is similar to the sling support 30 shown in FIGS. 1–5.

In a normal operating position, the support members 110 and 111 extend at an angle of 106° to one another as shown in FIG. 8. This gives the lifting device greatest stability.

However, the support members 110 and 111 can be displaced angularly by the power operated drive unit 118 to a position as shown in FIG. 7 in which they extend at no more than 20°, and preferably at about 16°, to one another for storage purposes.

The power operated drive unit 118 can angularly displace the two support members 110 and 111 between the position shown in FIG. 8 and a position in which the support members extend at about 55° to one another whilst carrying a load. This will enable the lifting device to be moved through doors. However, a control system including a load sensor (not shown) is provided to prevent the power operated drive unit 118 displacing the support members 110 and 111 to an angle of less than about 55° when the lifting device is carrying a load as a safety precaution. The control system also includes limit switches for stopping the drive unit 118 at extreme positions of the support members 110 and 111.

Both lifting devices described above can straddle a standard bed when in an extended condition and can pass through a doorway of standard width, whilst carrying a load, with the support members extending at about 55° to one another.

The above embodiments are given by way of example only and various modifications will be apparent to persons skilled in the art without departing from the scope of the invention.

We claim:

1. An invalid lifting device comprising two support members each having at least one vertical or substantially vertical leg and a transverse arm at or adjacent to an upper end of each said leg, the transverse arms of the respective two support members being connected together about a common vertical pivot axis for pivotable movement relative to one another about said common vertical pivot axis so that the two support members can be displaced angularly relative to one another, power operated means for pivoting the two transverse arms relative to one another, and a hoist supported by one of the support members.

2. An invalid lifting device as claimed in claim 1, wherein the power operated means comprise an electric motor indirectly supported by one of the transverse arms and rotatably connected to another of the transverse arms.

3. An invalid lifting device as claimed in claim 1, wherein the hoist comprises a power operated winch and a flexible elongate element which can be extended and retracted by the winch and a sling support connected to a free end of the flexible elongate element.

4. An invalid lifting device as claimed in claim 3, wherein the flexible elongate element depends from one of the transverse arms at or adjacent to the pivot axis of the transverse arms.

5. An invalid lifting device as claimed in claim 3, wherein the winch is supported by said at least one leg of one of the support members and the flexible elongate element extends from the winch following said at least one leg and extends away from one of the transverse arms at or adjacent to the pivot axis of the transverse arms.

6. An invalid lifting device as claimed in claim 1, wherein each said support member has two vertical or substantially vertical legs spaced apart from one another and connected together at or adjacent to their upper ends by the transverse arm associated with each support member.

7. An invalid lifting device as claimed in claim 6, wherein the transverse arms are pivotably connected together or substantially midway between ends of the transverse arms.

8. An invalid lifting device as claimed in claim 6, wherein lower ends of the legs are provided with rolling members.

9. An invalid lifting device as claimed in claim 8, wherein the legs of one of the support members may be provided with braking means comprising extendible feet which can be extended to engage a floor.

10. An invalid lifting device as claimed in claim 6, wherein the two support members are angularly displaceable relative to one another between a position in which the transverse arms extend perpendicularly or substantially perpendicularly to one another and a position in which the transverse arms extend at an angle no greater than 20° to one another.

11. An invalid lifting device as claimed in claim 1, wherein each support member has only one vertical or substantially vertical leg and stabilizing means are provided at a lower end of each leg to prevent the lifting device from falling over.

12. An invalid lifting device as claimed in claim 11, wherein the stabilizing means are in a form of elongate chassis members which are kept parallel or substantially parallel as the support members are pivoted relative to one another.

13. An invalid lifting device as claimed in claim 11, wherein each chassis member has two wheels or castors and is provided with braking means.

14. An invalid lifting device as claimed in claim 11, wherein the two support members are angularly displaceable relative to one another between a position in which the transverse arms extend at an angle of at least 90° to one another and a position in which the transverse arms extend at an angle no greater than 20° to one another.

15. An invalid lifting device as claimed in claim 1, where at least one of the legs is provided with a handle whereby an operator can move the hoist along a floor.

16. An invalid lifting device as claimed in claim 3, wherein the sling support comprises a sling hanger and a sling hanger support, the sling hanger support being connected to the free end of the flexible elongate element and the sling hanger being connected to the sling hanger support for pivotable movement about a horizontal or substantially horizontal axis and having two spaced sling attachment points on one side of the horizontal axis and at least one sling attachment point on another side of the horizontal axis.

17. An invalid lifting device comprising two support members each having at least one vertical or substantially vertical leg and a transverse arm at or adjacent to an upper end of each said leg, the transverse arms of the respective two support members being connected together about a common vertical pivot axis for pivotable movement relative to one another about said common vertical pivot axis so that the two support members can be displaced angularly relative to one another, power operated means for pivoting the two transverse arms relative to one another, wherein the two support members are movable relative to one another between a first position in which the support members can straddle a standard single hospital bed and a second position in which the support members can pass through a doorway of minimum standard width, and a hoist supported by one of the support members.

18. An invalid lifting device as claimed in claim 17, wherein the two support members are pivotally movable between said first and second positions and the hoist includes a flexible elongate element which is suspended from a position coincident with, or adjacent to, the common vertical pivot axis.

* * * * *